US007239334B2

(12) United States Patent
Ueda

(10) Patent No.: US 7,239,334 B2
(45) Date of Patent: Jul. 3, 2007

(54) PHOTO PRINTER

(75) Inventor: Hideo Ueda, Daito (JP)

(73) Assignee: Funai Electric Co., Ltd., Osaka (JP)

( * ) Notice: Subject to any disclaimer, the term of this patent is extended or adjusted under 35 U.S.C. 154(b) by 297 days.

(21) Appl. No.: 11/033,155

(22) Filed: Jan. 12, 2005

(65) Prior Publication Data

US 2005/0156982 A1 Jul. 21, 2005

(30) Foreign Application Priority Data

Jan. 19, 2004 (JP) ..... 2004-010557

(51) Int. Cl.
*B41J 2/00* (2006.01)

(52) U.S. Cl. ..... 347/188

(58) Field of Classification Search ..... 347/188, 347/211; 400/633, 279, 120.09
See application file for complete search history.

(56) References Cited

U.S. PATENT DOCUMENTS

2003/0227535 A1* 12/2003 Enomoto et al. ..... 347/188

FOREIGN PATENT DOCUMENTS

| | | |
|---|---|---|
| JP | 05-344295 A | 12/1993 |
| JP | 07-134003 | 5/1995 |
| JP | 2003-302887 | 10/2003 |
| JP | 2004-009610 | 1/2004 |

* cited by examiner

*Primary Examiner*—K. Feggins
(74) *Attorney, Agent, or Firm*—Global IP Counselors, LLP

(57) ABSTRACT

The photo printer has a conveyance unit, a printing unit, line sensors and a control unit. The conveyance unit conveys a roll paper along a conveyance path. The printing unit has a thermal head that prints images on the roll paper in a main scanning direction, which is perpendicular to the conveyance direction of the roll paper. The line sensors have a plurality of light emitting elements and light receiving elements disposed so as to span side edges of the conveyance path. The line sensors detect the roll paper on the conveyance path based on an amount of light received by the light receiving elements. The control unit detects a side edge of the roll paper, and also determines that a distal end of the roll paper is detected, based on the amount of light received by the light receiving elements.

9 Claims, 9 Drawing Sheets

PHOTO PRINTER

BACKGROUND OF THE INVENTION

1. Field of the Invention

The present invention relates to a photo printer for printing color images on roll paper, the roll paper being provided with yellow, magenta, and cyan heat-sensitive coloring layers.

2. Background Information

There are photo printers for printing color images on roll paper that is provided with yellow, magenta, and cyan heat-sensitive coloring layers. The following steps (1) to (5) are generally involved in printing color images.

(1) The heat sensitivity temperature for the thermal head is set to a first level, which is a temperature at which the yellow heat-sensitive coloring layer becomes colored, but the magenta and cyan heat-sensitive coloring layers do not become colored. This way, images in yellow are printed on the yellow heat-sensitive coloring layer in a printing region of the roll paper on which the current color image is to be printed.

(2) The yellow images printed in step (1) are exposed to the light of a yellow-fixing lamp.

(3) The heat sensitivity temperature for the thermal head is set to a second level, which is a temperature at which the magenta heat-sensitive coloring layer becomes colored, but the cyan heat-sensitive coloring layer does not become colored. This way, images in magenta are printed on the magenta heat-sensitive coloring layer in the printing region.

(4) The magenta images printed in step (3) are exposed to the light of a magenta-fixing lamp.

(5) The heat sensitivity temperature for the thermal head is set to a third level, which higher than the second level temperature. This way, images in cyan are printed on the cyan heat-sensitive coloring layer in the printing region.

The printing and exposure of images in steps (1) to (5) are performed while the roll paper is being conveyed. The printing region imprinted with the color images is cut off from the roll paper and ejected.

In this manner, yellow, magenta, and cyan images are thus printed in the printing region at different timings in an overlapping manner. The photo printer has a distal end detection sensor for detecting the distal end of the roll paper in order to prevent the images in the printing region from being offset in the conveyance direction of the roll paper. In a known photo printer, the distal end detection sensor is a reflection-type or transmission-type photo sensor disposed substantially in the widthwise middle of the conveyance path, such that the position of the roll paper in the conveyance direction is controlled based on the distal end detection timing, which the distal end detection sensor obtains by detecting the distal end of the roll paper.

The photo printer also has a side edge detection sensor for detecting a side edge of the roll paper in order to prevent printed images from becoming tilted due to slanted movement of the roll paper. The side edge detection sensor also prevents the printing images from being offset from one another in the main scanning direction (the width direction of the conveyance path), which is perpendicular to the conveyance direction of the roll paper. The side edge detection sensor includes a line sensor that is disposed so as to span the side edges of the roll paper being conveyed along the conveyance path. The line sensor determines as the border position of the roll paper the position between the light-receiving elements that detected the passage of the roll paper and the light-receiving element that did not detect the passage of the roll paper. In such photo printer, the main scanning direction position in which an image is to be printed with the thermal head is controlled based on the positions of the side edges of the roll paper detected by the side edge detection sensor.

In Japanese Laid-Open Patent Application No. 5-344295, position adjustment of roll paper in the main-scanning direction is performed by: reading with a scanner or other image-reading device a designated chart that has detection zones marked along the two sides of the roll paper; detecting a gap between the timing at which the line sensor detects the left side of the roll paper and the timing at which the line sensor detects the right side of the roll paper; and adjusting based on the gap in timings the position at which the line sensor starts reading the original image.

A conventional photo printer is disadvantageous, however, in that a distal end detection sensor and a side edge detection sensor need to be separately installed in the above-described manner, which increases the cost of the photo printer.

In view of the above, it will be apparent to those skilled in the art from this disclosure that there exists a need for an improved photo printer that overcomes the above described problems of the conventional art. This invention addresses this need in the art as well as other needs, which will become apparent to those skilled in the art from this disclosure.

SUMMARY OF THE INVENTION

An object of this invention is to provide a photo printer having a line sensor that detects both side edge and distal edge of a paper.

The photo printer of this invention is configured in the following manner in order to attain the stated object.

A photo printer in accordance with the present invention is adapted to print on a roll paper, and includes a conveyance unit that is adapted to convey the roll paper along a conveyance path; a printing unit having a thermal head that is adapted to print in a main scanning direction on the roll paper, the main scanning direction being perpendicular to the conveyance direction of the roll paper; a line sensor unit having a plurality of light emitting elements and light receiving elements disposed so as to span a side edge of the conveyance path; and a control unit operatively coupled to the conveyance unit, the printing unit, and the line sensor unit, the control unit being adapted to detect the roll paper on the conveyance path based on an amount of light received by the light receiving elements, the control unit being also adapted to detect a side edge of the roll paper based on the amount of light received by the light receiving elements, the control unit being further configured to determine that a distal end of the roll paper is detected based on the amount of light received by the light receiving elements.

In this arrangement, the control unit detects the side edges of the roll paper based on the amount of light received by the light-receiving elements of a line sensor, which are arranged so as to span the side edge of the roll paper being conveyed by the conveyance unit along the conveyance path. In addition, the control unit is further configured to determine that a distal end of the roll paper is detected based on the amount of light received by the light receiving elements.

Thus, the number of sensors mounted on the photo printer can be reduced because the line sensor unit can be used to detect both the side edges and the distal end of roll paper conveyed along a conveyance path. Accordingly, the cost of manufacturing the photo printer can thereby be reduced.

Preferably, in the photo printer in accordance with the present invention, the line sensor unit has an external region and an internal region, the light-receiving elements that are disposed outside the conveyance path belonging to the external region, some of the light-receiving elements that are disposed inside the conveyance path belonging to the internal region, and the control unit is configured to determine that the distal end of the roll paper is detected in setting the threshold value when a change in the amount of light received by the light receiving elements in the internal region exceeds a predetermined threshold value, the threshold value being a mean value of the amounts of light received by the light-receiving elements in the external and internal regions if the line sensor unit detects the roll paper in the conveyance path, and a value obtained based on a predetermined adjustment value and the amount of light received by the light-receiving elements in the external or internal region if the line sensor unit does not detect the roll paper in the conveyance path.

The light-receiving elements belonging to the external region are the elements disposed in an area outside the conveyance path, in which the roll paper is not expected to be detected in a normal state even if the roll paper is conveyed by the conveyance unit in a slanted manner. The control unit sets the threshold value for determining the presence of the roll paper based on the amount of light received by the light-receiving elements in the external and/or internal region. For example, the control unit sets as the threshold value a value obtained by adding a predetermined adjustment value to the amount of light received by the light-receiving elements in the external region.

Before the printing unit prints an image on the roll paper, the control unit obtains the amount of light received by the light-receiving elements in the internal region. In this case, the light-receiving elements in the internal region are disposed in an area in which the roll paper is expected to be detected in a normal state even when the roll paper is conveyed by the conveyance unit in a slanted manner. The control unit also determines that the distal end is detected when a change in the amount of light received by the light-receiving elements in the internal region exceeds a predetermined threshold value.

Roll paper is generally conveyed along the conveyance path during the printing, and remains wound up in other times. Accordingly, the amounts of light received by the light-receiving elements in the external and internal regions are usually substantially the same before the printing unit performs the printing. There are cases in which the roll paper remains on the conveyance path without being wound after the previous printing. For example, the roll paper may remain on the conveyance path if the photo printer is switched off before the roll paper is wound up after the printing region is separated and ejected from the roll paper. In such cases the difference between the amounts of light received by the light-receiving elements in the external and internal regions tends to be greater.

In this arrangement, the control unit determines if the line sensor detected the roll paper, the control unit sets the threshold value as the center value of the amounts of light received by the light-receiving elements in the external or internal regions. It is therefore possible to set the threshold value in accordance with the actual amount of light received. Accordingly, it is possible to improve the accuracy of detecting the distal end of the roll paper when the paper is disposed in the conveyance path without being wound by the paper feed unit.

In addition, the presence of roll paper in the conveyance path is determined before the printing unit performs the printing. Therefore, it is possible to rapidly respond to any abnormalities that may occur when the roll paper is wound by the paper feed unit or when other operations related to the printing are performed.

These and other objects, features, aspects and advantages of the present invention will become apparent to those skilled in the art from the following detailed description, which, taken in conjunction with the annexed drawings, discloses a preferred embodiment of the present invention.

BRIEF DESCRIPTION OF THE DRAWINGS

Referring now to the attached drawings which form a part of this original disclosure.

DETAILED DESCRIPTION OF THE PREFERRED EMBODIMENTS

Selected embodiments of the present invention will now be explained with reference to the drawings. It will be apparent to those skilled in the art from this disclosure that the following descriptions of the embodiments of the present invention are provided for the purpose of illustration only and not for limiting the invention as defined by the appended claims and their equivalents.

A photo printer 1 in accordance an embodiment of this invention will now be described.

Overall Structure of Photo Printer

Figure 1:
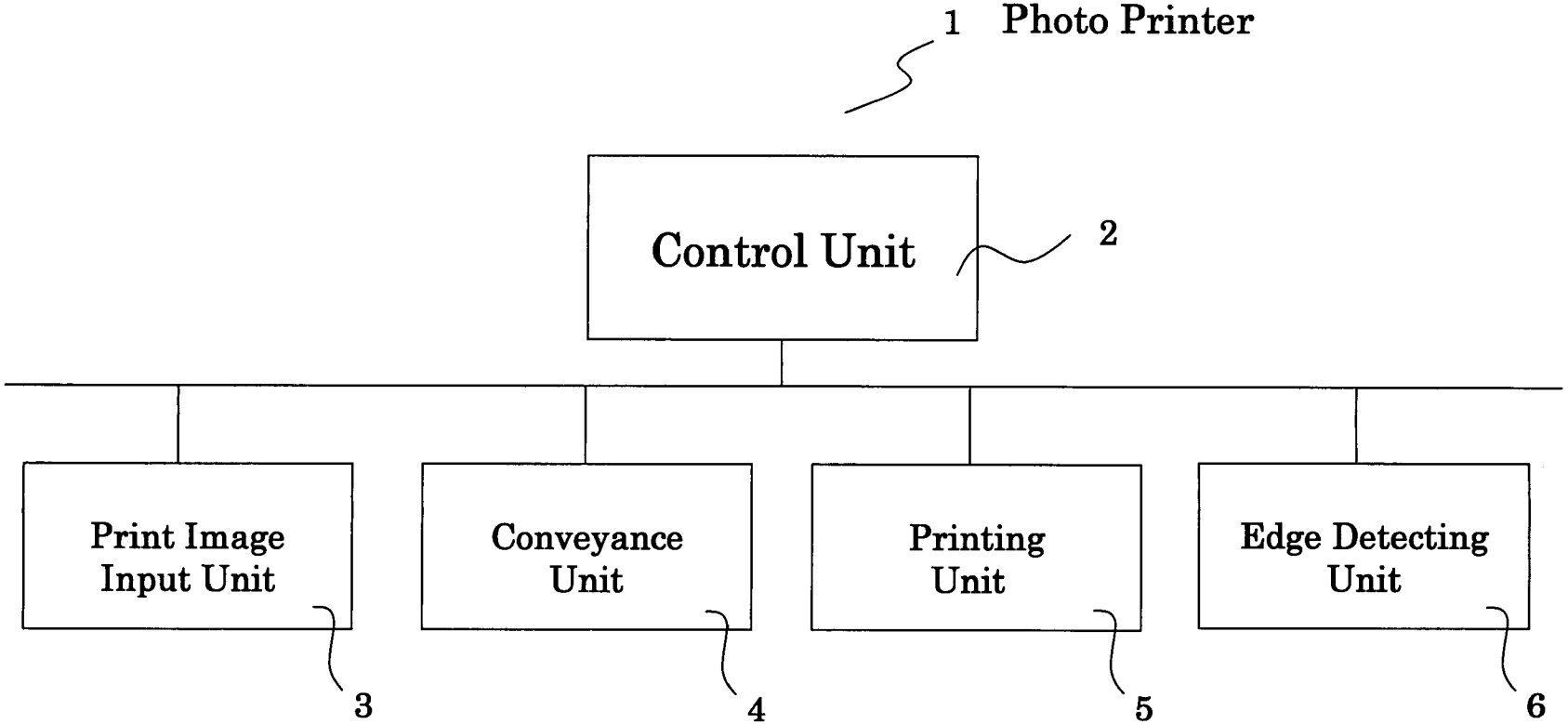
FIG. 1 is a diagram showing the structure of a photo printer in accordance with an embodiment of this invention.

FIG. 1 is a block diagram showing the structure of a photo printer 1 in accordance with the embodiment of the present invention. The photo printer 1 has a control unit 2 for controlling the operation of various components of the photo printer 1, a print image input unit 3 for receiving an input of color images to be printed, a conveyance unit 4 which conveys the roll paper that is mounted on the printer along a conveyance path, a printing unit 5 for printing color images on the roll paper mounted on the printer, and an edge detecting unit 6 for detecting the distal end and the two side edges of the roll paper being conveyed along the conveyance path.

The control unit 2 preferably includes a microcomputer with control programs that control various units as discussed below. The control unit 2 can also include other conventional components such as an input interface circuit, an output interface circuit, and storage devices such as a ROM (Read Only Memory) device and a RAM (Random Access Memory) device. The control unit 2 is operatively coupled to the print image input unit 3, the conveyance unit 4, the printing unit 5, and the edge detecting unit 6, so as to be able to selectively control any of the units connected thereto.

The print image input unit 3 may be configured so that images sent from a personal computer or other external device are received as print images, or that images stored on a mounted memory card or other storage medium are retrieved as print images. The conveyance unit 4 has a motor and a rotation sensor not shown in Figures. The rotation sensor senses the rotation of the motor. Rotation data thus obtained are sent to the control unit 2, such that the control unit 2 can determine how much of the roll paper has been conveyed based on the rotation data. The control unit 2 can also control the amount of the roll paper to be conveyed by controlling the motor. The control unit 2 instructs the conveyance unit 4 to convey the roll paper based on the timing at which the edge-detecting unit 6 detected the distal end of the roll paper, and instructs the printing unit 5 on the printing position of the roll paper in the conveyance direction. The control unit 2 also instructs the printing unit 5 on the printing position of the roll paper in the main scanning direction, which is perpendicular to the conveyance direction of the roll paper, based on the position of the two side edges of the roll paper detected by the edge-detecting unit 6. The printing unit 5 adjusts the printing position in the main scanning direction in accordance with the instructions from the control unit 2.

Figure 2:
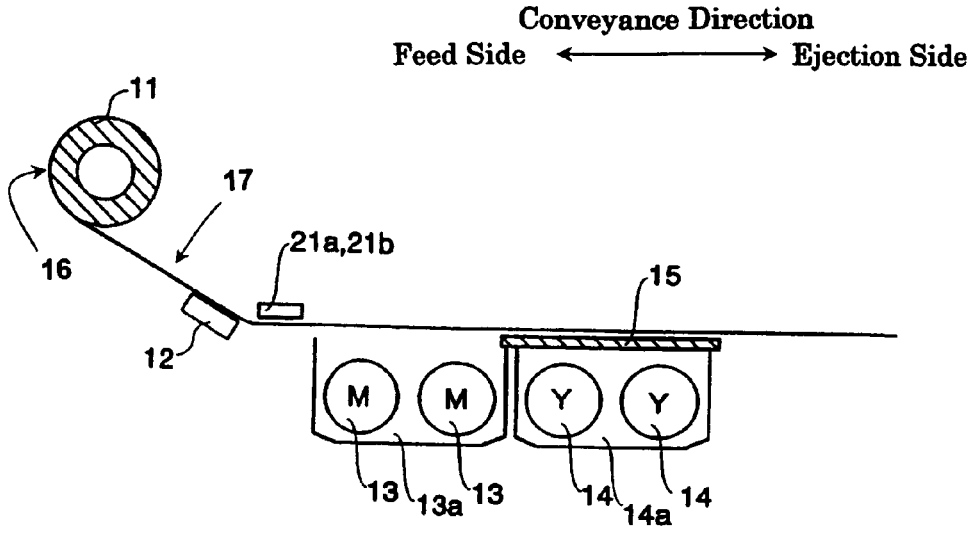
FIGS. 2(*a*) and 2(*b*) are diagrams showing the printing unit and the edge-detecting unit of the photo printer in accordance with the embodiment of the present invention.
Figure 2:
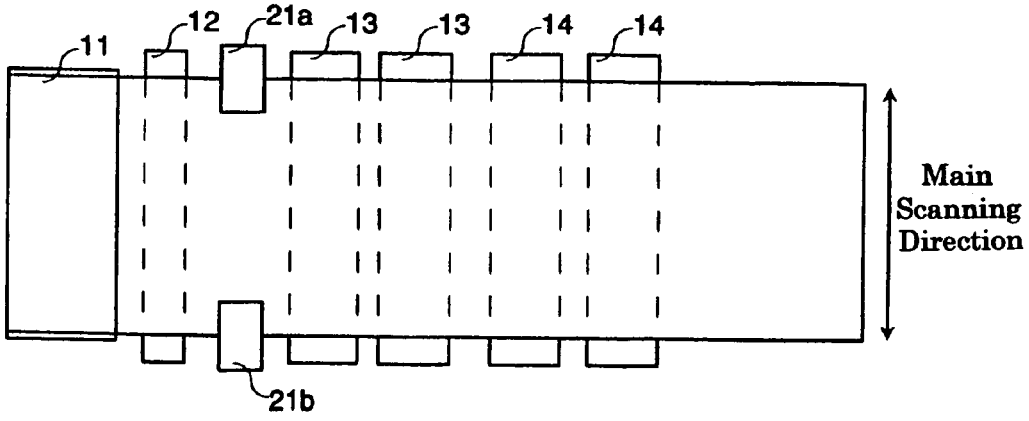

FIG. 2 is a schematic diagram showing the printing unit and the edge detecting unit of the photo printer according to the embodiment of the present invention. FIG. 2(A) is a lateral sectional view, while FIG. 2(B) is a top plan view. In FIG. 2, a roll paper 11 is mounted in a paper feed unit 16. The roll paper 11 is thermo-autochrome paper provided with yellow, magenta, and cyan heat-sensitive coloring layers. A thermal head 12 allows printing in different colors by varying the temperature according to the heat sensitivity temperature of each of the yellow, magenta, and cyan heat-sensitive coloring layers of the roll paper 11, and thereby printing images in different colors by using different heat sensitivities. A magenta-fixing lamp 13 is for exposing to light and stabilizing the magenta images printed on the magenta heat-sensitive coloring layer. A yellow-stabilizing lamp 14 is for exposing to light and stabilizing the yellow images printed on the yellow heat-sensitive coloring layer. The thermal head 12, the magenta-stabilizing lamp 13, and the yellow-stabilizing lamp 14 are arranged in this order along the conveyance path of the roll paper 11 in the direction from the feed side to the ejection side. In addition, a shutter 15 allows non-print regions, which are not used for printing color images, to be prevented from being exposed to the light of the magenta-stabilizing lamp 13 or yellow-stabilizing lamp 14. Also, a reflector 13*a* accommodates the magenta-stabilizing lamp 13, while a reflector 14*a* accommodates the yellow-stabilizing lamp 14.

Figure 9:
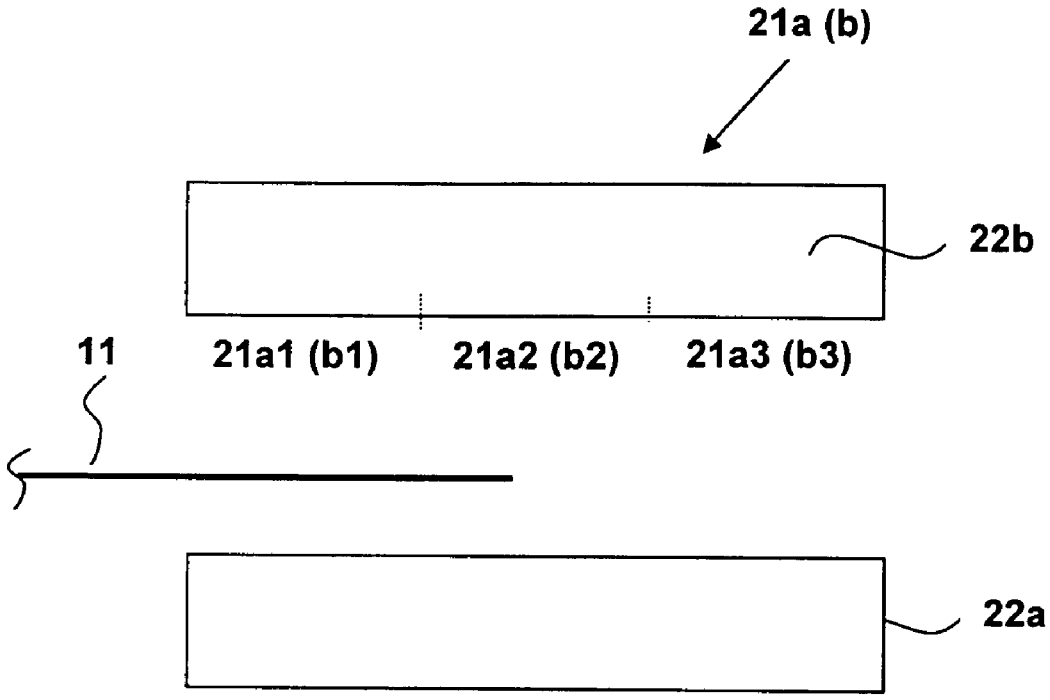
FIG. 9 is a diagram illustrating the line sensor used in the photo printer in accordance with the embodiment of the present invention.

In addition, line sensors 21*a*, 21*b*, collectively a line sensor unit 21, are arranged so as to span the side edges on both sides of the roll paper 11. Each of the line sensors 21*a*, 21*b* is arranged to span either side edge of the conveyance path of the roll paper 11. The line sensors 21*a*, 21*b* are, for example, CIS sensors containing light sources (LED array) 22*a* and light-receiving elements (CCD array) 22*b*, as shown schematically in FIG. 9. The plurality of light-receiving elements contained in the line sensors 21*a*, 21*b* is arranged in a line extending in the main scanning direction. The line sensors 21*a*, 21*b* are disposed in the vicinity of the thermal head 12 on the ejection side.

Figure 3:
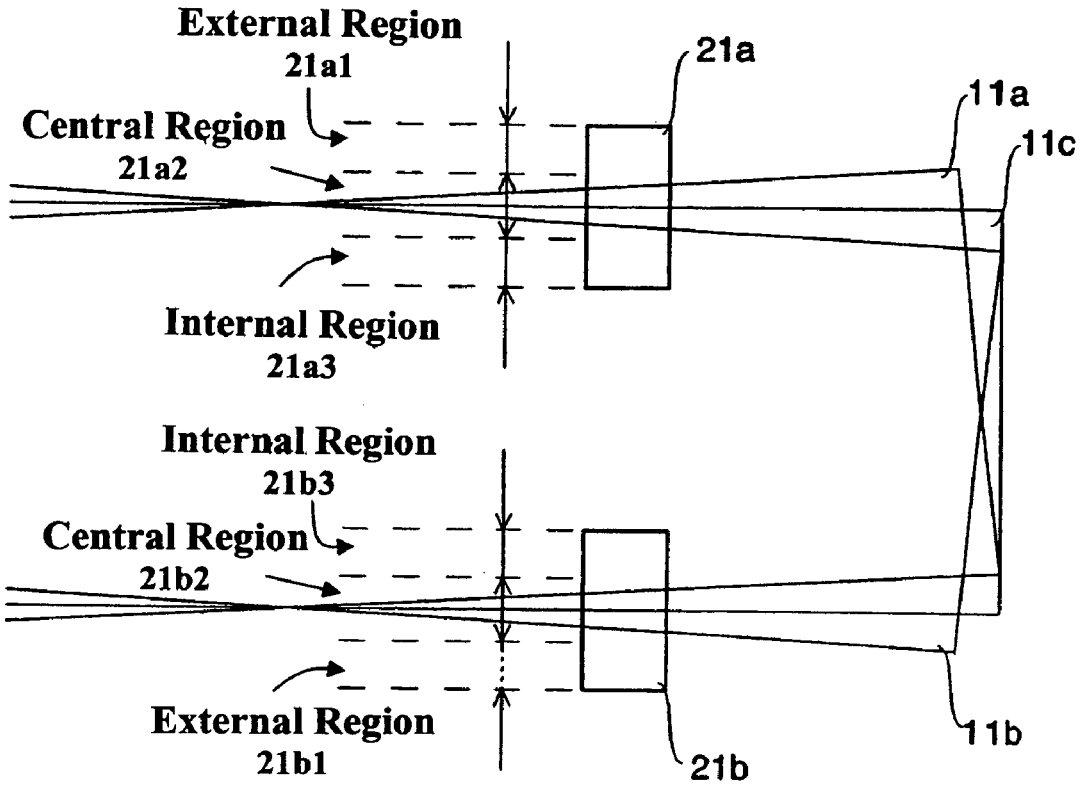
FIG. 3 is a diagram illustrating the line sensor regions in accordance with the embodiment of the present invention.

The light-receiving elements of each of the line sensors 21*a* and 21*b* are divided into three regions: an external region 21*a*1 or 21*b*1, a central region 21*a*2 or 21*b*2, and an internal region 21*a*3 or 21*b*3, as shown in FIG. 3. The external regions 21*a*1 and 21*b*1 are composed of light-receiving elements that are disposed in areas in which the roll paper 11 is not expected to be detected even when the roll paper 11 is conveyed by the conveyance unit 4 in a slanted manner. The internal regions are composed of light-receiving elements that are disposed in an area in which the roll paper 11 is always expected to be detected regardless of whether the roll paper 11 is conveyed by the conveyance unit 4 in a slanted manner or not. The central regions 21*a*2 and 21*b*2 are composed of light-receiving elements that belong to neither the external regions 21*a*3 and 21*b*3 nor the internal regions 21*a*1 and 21*b*1. The light-receiving elements of the central regions 21*a*2 and 21*b*2 may or may not detect the roll paper 11, primarily depending on whether the roll paper 11 is conveyed in a slanted manner. In FIG. 3, the roll paper 11*a* shows a roll paper that is conveyed in a manner slanted toward the line sensor 21*a*. The roll paper 11*b* shows a roll paper that is conveyed in a manner slanted toward the line sensor 21*b*. The roll paper 11*c* shows a roll paper that is conveyed in a normal manner.

These line sensors 21*a* and 21*b* are utilized for detection of distal end of the roll paper 11 as well as detection of side edges of the roll paper 11. The manner in which the distal end of the roll paper 11 is detected using sensed values of the line sensors 21*a* and 21*b* will be explained in detail below. The side edges of the roll paper 11 are detected using the sensed values of light-receiving elements in the central regions 21*a*2 and 21*b*2 of the line sensors 21*a* and 21*b*, based on the amount of light received by the light-receiving elements of each of the central regions 21*a*2 and 21*b*2 of the line sensors 21*a* and 21*b*. Although it is assumed herein that the line sensors 21*a* and 21*b* are CIS sensors, the CCD array and the LED array may also be provided separately.

Edge Detecting Unit

Figure 4:
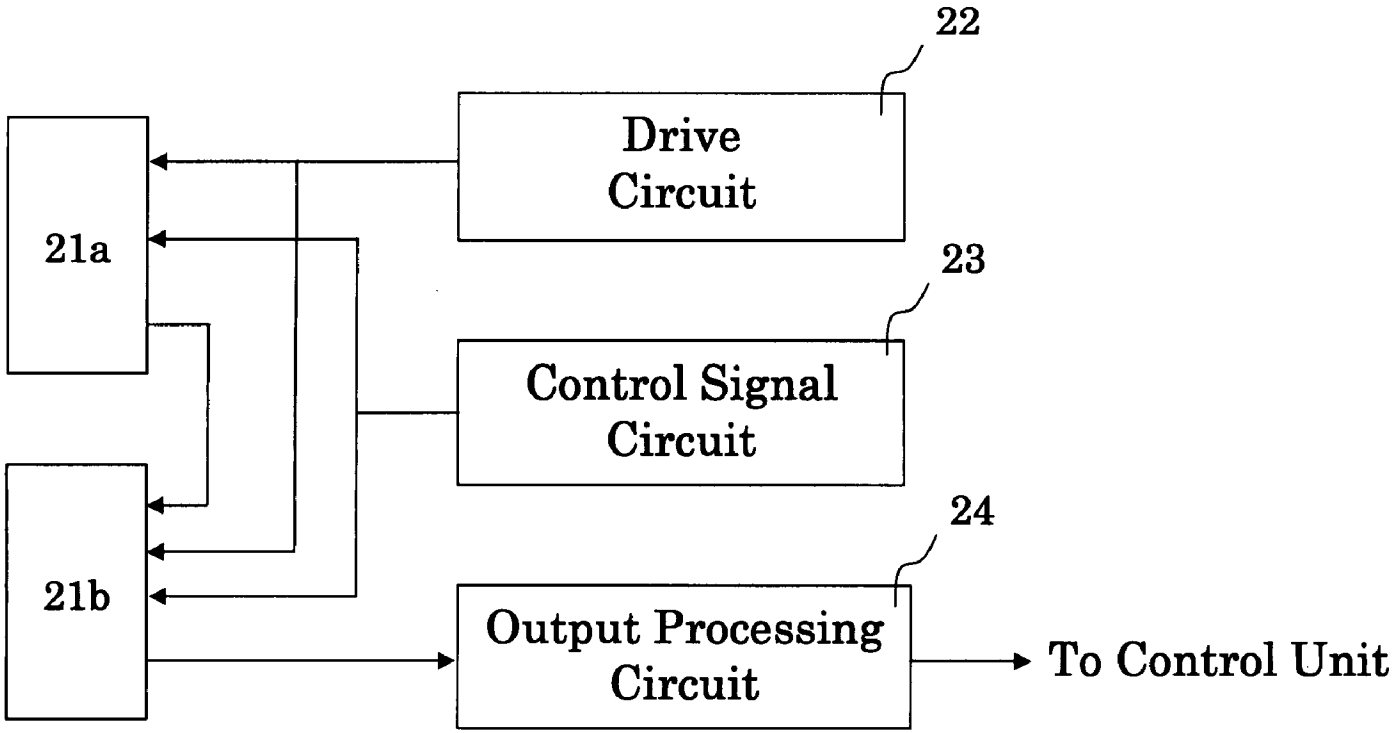
FIG. 4 is a diagram showing the circuit structure of the edge-detecting unit of the photo printer in accordance with the embodiment of the present invention.

The structure of the edge-detecting unit 6 will next be described with reference to FIG. 4. The edge-detecting unit 6 has, as shown in FIG. 4, a drive circuit 22 for illuminating the LEDs contained in the line sensors 21*a* and 21*b*, a control signal circuit 23 for providing the line sensors 21*a* and 21*b* with a clock or a start pulse that indicates the beginning of the sensing operation, and an output processing circuit 24 for processing the output of the line sensors 21*a* and 21*b*. The two sensors 21*a* and 21*b* are connected via a cascade connection, such that an output from the line sensor 21*a*, in other words the sensed value that indicates the amount of light received from the light-receiving elements, is input to the output processing circuit 24 via the line sensor 21*b*. The drive circuit 22 and the control signal circuit 23 input LED drive signals, clock pulses, and start pulses in parallel to the line sensors 21*a* and 21*b*.

The control signal circuit 23 provides the line sensors 21*a* and 21*b* with clock pulses obtained by dividing the operating clock of a CPU (not shown in Figures). The CPU is included in the control unit 2. The control signal circuit 23 provides the line sensors 21*a* and 21*b* with start pulses at timings indicated by the control unit 2. The output processing circuit 24 converts the sensed values of the light-receiving elements of the line sensors 21*a* and 21*b* into digital values by A/D conversion, and sends the converted values to the control unit 2. Based on the sensed values of the light-receiving elements of the line sensors 21*a* and 21*b* sent from the output processing circuit 24, the control unit 2 detects the distal end and the two side edges of the roll paper 11 being conveyed along the conveyance path. The control unit 2 instructs the conveyance unit 4 to convey the roll paper 11 based on the timing at which the distal end of the roll paper 11 has been detected, and adjusts the printing position of the thermal head 12 in the conveyance direction of the roll paper 11. The control unit 2 also instructs the printing unit 5 regarding the printing position of the thermal head 12 in the main scanning direction based on the positions of the two side edges of the roll paper 11 thus detected, and adjusts the printing position of the thermal head 12 in the main scanning direction of the roll paper 11.

Operation of Photo Printer

Figure 5:
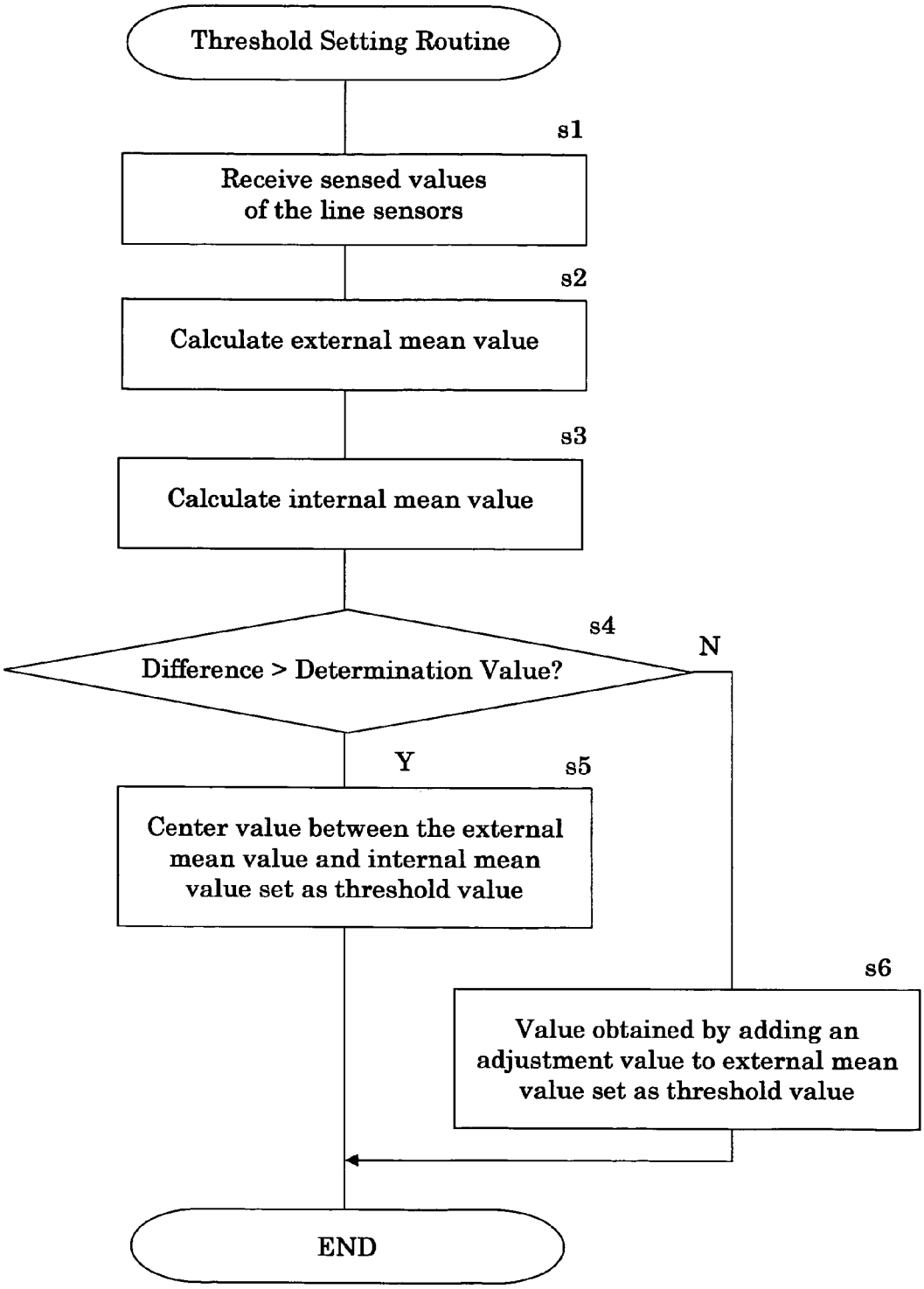
FIG. 5 is a flowchart showing the threshold setting routine of the photo printer in accordance with the embodiment of the present invention.

The operation of the photo printer 1 according to this embodiment will now be described. In the photo printer 1 according to this embodiment, the control unit 2 performs, when the power of the photo printer 1 is turned on, a threshold setting routine for setting the threshold value to detect the distal end of the roll paper 11. FIG. 5 is a flowchart showing the threshold setting routine.

Threshold Setting Routine

Although the threshold setting routine is performed when the power of the photo printer 1 is turned on in this embodiment, the timing at which the threshold setting routine is to be performed is not limited to the time when the power is turned on. The threshold setting routine may also be performed when, for example, when the control unit 2 receives a print request, or any other time.

In the photo printer 1, the control unit 2 receives the sensed values of the light-receiving elements of the line sensors 21*a* and 21*b* via the output processing circuit 24 of the edge detecting unit 6 (step s1). The photo printer 1 performs the step s2 and subsequent processing steps described below for each of the line sensors 21*a* and 21*b*, such that the threshold value used in detection of the distal end of the roll paper 11 is determined for each of the line sensors 21*a* and 21*b*. In this description, threshold value determination for the line sensor 21*a* will be explained as an example, but the same steps s2-s6 are performed for the line sensor 21*b* too.

In step s2, the control unit 2 calculates the mean value (referred to hereinafter as "the external mean value") of the sensed values of the light-receiving elements that belong to the external region 21*a*3 of the line sensor 21*a*, using the sensed values received in step s1. The mean value of the sensed values is the mean value of the amount of light received by the light-receiving elements per unit time. In step s3, the control unit 2 also calculates the mean value (referred to hereinafter as "the internal mean value") of the sensed values of the light-receiving elements that belong to the internal region 21*a*. In step s4, the control unit 2 determines whether the difference between the external mean value calculated in step s2 and the internal mean value calculated in step s3 is greater than a predetermined determination value.

Roll paper is generally conveyed along the conveyance path during the printing, and remains wound up in other times. Accordingly, in the photo printer 1, the roll paper 11 usually remains wound up and is not rolled out and placed on the conveyance path where the line sensor 21*a* can detect the roll paper when no processing is performed to print color images. There are, however, cases in which the roll paper 11 may be rolled out in the conveyance path, instead of being wound in a roll. For example, the roll paper 11 may be disposed in the conveyance path because the power of the photo printer 1 has been turned off right after the roll paper 11 is ejected and cut off at the printing area.

If the roll paper 11 is not disposed in the conveyance path, the light-receiving elements in either of the external region 21*a*3 and the internal region 21*a*1 of the line sensor 21*a* do not detect the roll paper 11. In other words, the amount of light received by the light-received elements indicates the quantity of light-receiving elements that are not detecting the roll paper 11. Therefore, the external mean value and internal mean value calculated in step s2 and step s3 are the same values, and the difference between the external mean value and the internal mean value is very small. When, however, the roll paper 11 is placed in the conveyance path, the light-receiving elements in the external region 21*a*3 of the line sensor 21*a* do not detect the roll paper 11, while the light-receiving elements in the internal region 21*a*1 of the line sensor 21 a detect the roll paper 11. Therefore, the difference between the external mean value and internal mean value is large. The determination value used in s4 is preconfigured so as to be substantially half the value of the difference between the external mean value and the internal mean value, which would be obtained when the roll paper 11 is placed on the detection position of the line sensor 21*a* in the conveyance path.

If the difference between the external mean value and the internal mean value is greater than the determination value in step s4, the control unit 2 proceeds to step s5, where the control unit 2 sets the center value between the external mean value and internal mean value (mean value of the external mean value and internal mean value) as the threshold value. Also, when the roll paper 11 that should be wound up is not wound up unbeknownst to the user for some reason, the determination in step s4 can reveal that the roll paper 11 has not been wound. Accordingly, the control unit 2 can control the conveyance unit 4 to wind the roll paper 11 automatically or issue an alert to the user that the roll paper 11 has not been wound.

If, on the other hand, the difference between the external mean value and the internal mean value is smaller than the determination value in step s4, the control unit 2 proceeds to step s6, where the control unit 2 sets a value obtained by adding a predetermined adjustment value to the external mean value calculated in step s2 is set as the threshold value. The adjustment value to be added in step s6 is predetermined, and is substantially equal to a half of the difference (estimate) between the external mean value and the internal mean value that are obtained when the roll paper 11 is placed on the detection position of the line sensor 21*a*. The adjustment value is positive when the line sensor is a reflective type, and negative when the line sensor is a transmission type.

As is clear from the above description, both the determination value in step s4 and the adjustment value is step s6 are set to be substantially a half of the difference between the external mean value and the internal mean value, although the determination value in step s4 is a preconfigured value, while the adjustment value in step s6 is a value obtained by calculating the external mean value and the internal mean value obtained in steps s2 and s3. In addition, although the threshold value is obtained by adding the adjustment value to the external mean value in step s6 of the present embodiment, the threshold value may alternatively be obtained by adding the adjustment value to the internal mean value.

Thus, in the photo printer 1, the above-described threshold setting routine is performed to set the threshold value when the power of the photo printer 1 is switched on, and the threshold value used in detecting the distal end of the roll paper 11 is thus set. Since it is also determined at this time whether the roll paper 11 is wound in the conveyance path, the photo printer 1 can issue an alert to notify the user whether the roll paper 11 is or is not wound up.

Printing Routine

Figure 6:
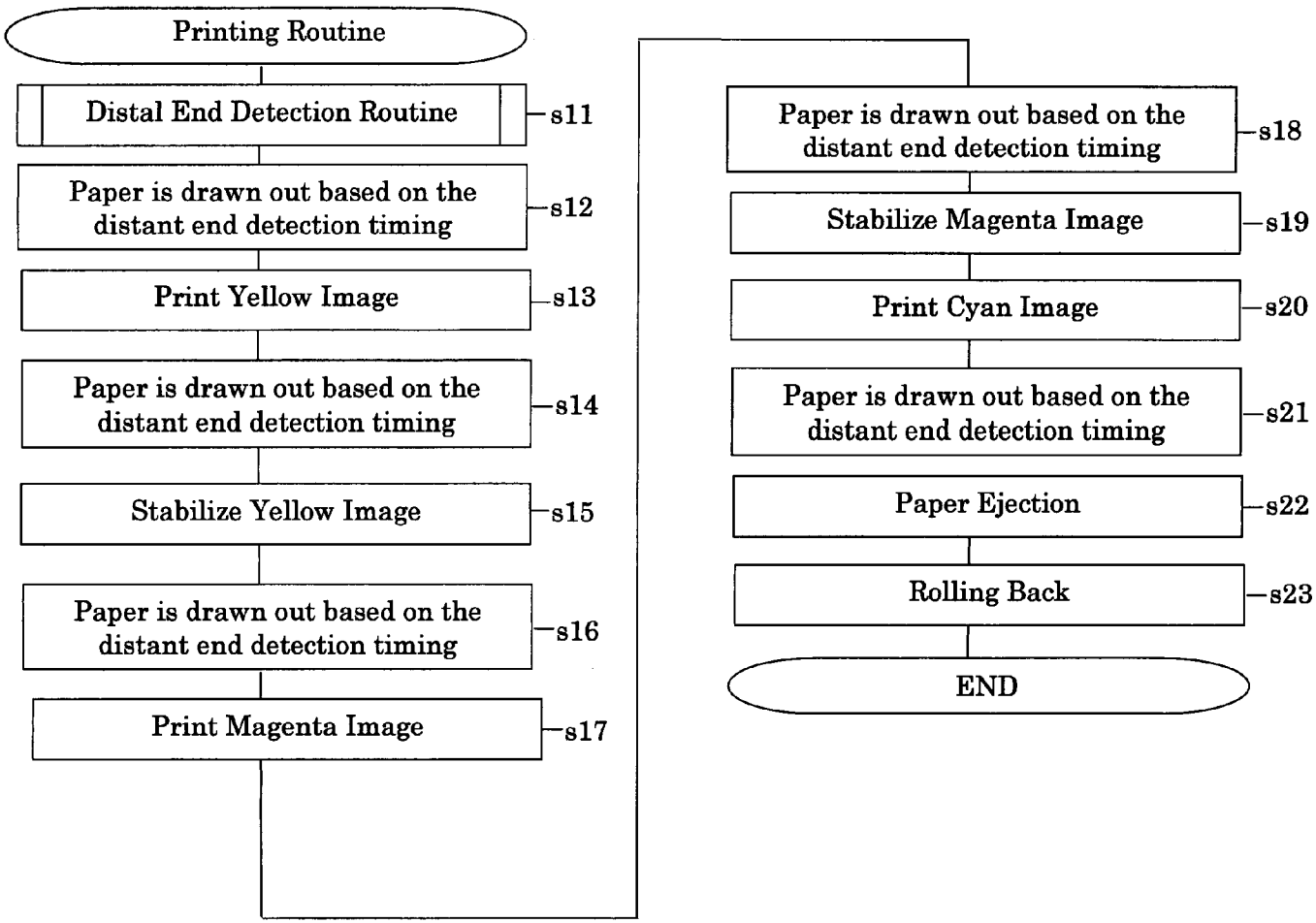
FIG. 6 is a flowchart showing the printing routine of the photo printer in accordance with the embodiment of the present invention.
Figure 7:
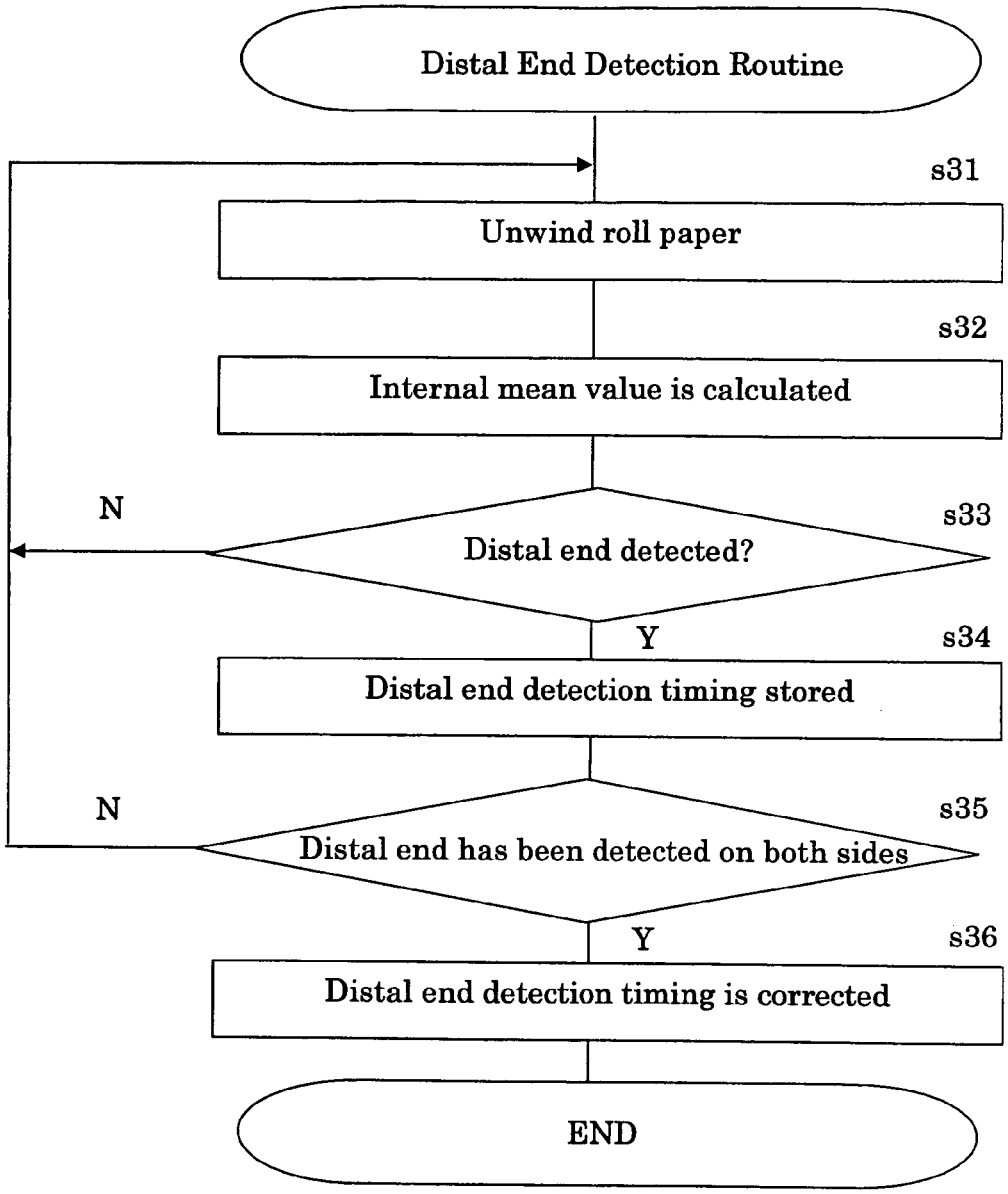
FIG. 7 is a flowchart showing the distal end detection routine of the photo printer in accordance with the embodiment of the present invention.

The processing involved in printing color images in the photo printer 1 according to this embodiment will next be described. FIG. 6 is a flowchart showing the routine for printing color images in the photo printer 1 according to this embodiment. The photo printer 1 starts this printing routine upon receipt of a request to print color images. The roll paper 11 is wound at this time. Upon receipt of the request to print color images, a distal end detection routine shown in FIG. 7 is performed in step s11 for detecting the distal end of the roll paper 11. Also, prior to the distal end detection routine of step s11, internal mean values of the amount of light received by the light receiving elements in the internal regions 21*a*1 and 21*b*1 of the line sensors 21*a* and 21*b* are obtained in advance, without the roll paper 11 being on the conveyance path 17.

In the distal end detection routine of step s11 shown in FIG. 7, the photo printer 1 starts unwinding the roll paper 11 in step s31. In step s32, the internal mean value is calculated for each of the line sensors 21*a* and 21*b*, as shown in FIG. 7.

In step s33, it is then determined whether a distal end of the roll paper 11 has been detected on the detection positions, where the line sensors 21*a* and 21*b* are located. Specifically, if the difference between the internal mean value obtained in advance and the internal mean value obtained in step s32 is greater the threshold value that has been obtained through the threshold setting routine shown in FIG. 5, it is determined that the distal end has been detected by the line sensor 21*a* or 21*b* in step s33. This determination is performed for each of the line sensors 21*a* and 21*b*. Once the distal end is detected in step s34, the time at which the distal end was detected by the line sensor 21*a* or 21*b* is stored in a memory of the control unit 2 in step 34. The timing at which the distal end is detected is stored for each of the line sensors 21*a* and 21*b*. The control unit 2 then proceeds to step s35.

In step 35, the control unit 2 determines whether both of the line sensors 21*a* and 21*b* have detected the distal end of the roll paper 11. These steps s31 through s34 described above are repeated until both of the line sensors 21*a* and 21*b* detect the distal end of the roll paper 11. When both of the line sensors 21*a* and 21*b* have detected the distal end, the control unit 2 proceeds to step s36.

Once both of the line sensors 21*a* and 21*b* have detected the distal end of the roll paper 11, the control unit 2 compares the distal end detection timings of the line sensors 21*a* and 21*b*, and corrects the difference, if any, between the two distal end detection timings in step s36. The corrected distal end detection timing, which is the mean value of the distal end detection timings of both of the line sensors 21*a* and 21*b*, is stored. The difference between the distal end detection timings of the line sensors 21*a* and 21*b* due to the slanted movement of the roll paper 11 is thus corrected by adopting the mean value of the distal end detection timings of the line sensors 21*a* and 21*b* as the corrected distal end detection timing of the roll paper 11 as a whole. The control unit 2 then returns to the printing routine.

In step s12, the control unit 2 controls the manner in which the roll paper 11 is rolled out by the conveyance unit 4 based on the distal end detection timing obtained in s11. The control unit 2 controls the conveyance unit 4 to roll out the roll paper 11 until the rear end of the printing region in which the image that has been input to the print image input unit 3 is to be printed is placed on the ejection side of the line sensors 21*a*, 21*b*. Then, in step s13, images in yellow are printed on the printing region with the thermal head 12 while pulling the roll paper 11 back toward the feed side. At this time, the control unit 2 of the photo printer 1 controls the printing position on the roll paper 11 in the conveyance direction based on the distal end detection timing detected in step s11. The control unit 2 also receives the sensed values of the light-receiving elements from the edge detecting unit 6, and thereby detects the positions of the two side edges of the roll paper 11 being conveyed along the conveyance path based on the sensed values of the line sensors 21*a* and 21*b*. The control unit 2 then instructs the printing unit 5 as to the main scanning direction position at which the thermal head 12 is to perform the printing based on the positions of the two side edges of the roll paper 11 thus detected. The printing unit 5 prints images in yellow in accordance with the instruction while adjusting the main scanning direction position of the thermal head 12.

When the photo printer 1 completes the printing of the images in yellow, the roll paper 11 in step s14 is rolled out on the conveyance path toward the ejection side. The manner in which the roll paper 11 is rolled out by the conveyance unit 4 is controlled based on the distal end detection timing obtained in step s11, such that the print region of the roll paper 11 on which the images in yellow has been printed is placed slightly on the ejection side of the exposure region of the yellow-fixing lamp 14. In step s15, the region on which the images in yellow have been printed is exposed to the light of the yellow-fixing lamp 14 while the roll paper 11 is being pulled back to the feed side, such that the images in yellow are stabilized. At this time, in order to prevent regions of the roll paper 11 on which the yellow images are not printed from being exposed to the yellow-fixing lamp 14, such regions are covered with a shutter 15 while passing through the yellow-fixing lamp 14. Accordingly, the control unit 2 controls the movement of the shutter 15 based on the distal end detection timing detected in s14.

When the photo printer 1 completes stabilizing the images in yellow in step s15, the roll paper 11 is further rolled out in step s16. The manner in which the roll paper 11 is rolled out by the conveyance unit 4 is controlled based on the distal end detection timing obtained in step s11. The control unit 2 controls the conveyance unit 4 such that the rear end of the print region of the roll paper 11 on which the images in yellow have been printed and stabilized and on which new images received by the print image input unit 3 are to be printed in magenta is placed slightly on the ejection side of the line sensors 21*a* and 21*b*. Then, in step s17, images in magenta are printed on the printing region with the thermal head 12 while pulling the roll paper 11 back toward the feed side. At this time, the control unit 2 of the photo printer 1 controls the printing position on the roll paper 11 in the conveyance direction based on the distal end detection timing detected in step s11. The control unit 2 also receives the sensed values of the light-receiving elements from the edge detecting unit 6, and thereby detects the positions of the two side edges of the roll paper 11 being conveyed along the conveyance path based on the sensed values of the line sensors 21*a* and 21*b*. The control unit 2 then instructs the printing unit 5 as to the main scanning direction position at which the thermal head 12 is to perform the printing based on the positions of the two side edges of the roll paper 11 thus detected. The printing unit 5 prints images in magenta in accordance with the instruction while adjusting the main scanning direction position of the thermal head 12.

When the photo printer 1 completes the printing of the images in magenta, the roll paper 11 in step s18 is rolled out on the conveyance path toward the ejection side. The manner in which the roll paper 11 is rolled out by the conveyance unit 4 is controlled based on the distal end detection timing obtained in step s11. The control unit 2 controls the conveyance unit 4 such that the print region of the roll paper 11 on which the images in magenta have been printed is exposed to the light of the magenta-fixing lamp 13 in step s19. In this manner, the images in magenta are stabilized. At this time, to prevent regions of the roll paper 11 that are not used for printing the magenta images from being exposed to the magenta-fixing lamp 13, the control unit 2 is configured to stop the conveyance unit 4 and turn off the magenta-fixing lamp 13 for a predetermined time once the rear end of the print region on which the magenta images have been printed reaches the feed side end of the exposure area of the magenta-fixing lamp 13. The duration of time during which the conveyance of the roll paper 11 is stopped is determined based on the distal end detection timing detected in s11.

Once the photo printer 1 completes the printing of the images in magenta, images in cyan are subsequently printed with the thermal head 12 while the roll paper 11 is pulled back toward the feed side (step s20). At this time, the control unit 2 of the photo printer 1 controls the position in which the image is to be printed on the roll paper 11 in the conveyance direction based on the distal end detection timing detected in s11. The control unit 2 also detects the positions of the two side edges of the roll paper 11 being conveyed along the conveyance path from the sensed values of the line sensors 21*a* and 21*b* received from the edge detecting unit 6, and instructs the printing unit 5 as to the main scanning direction position at which the thermal head 12 is to perform the printing based on the positions of the two side edges of the roll paper 11 thus detected. The printing unit 5 prints images in cyan in accordance with the instruction while adjusting the main scanning direction position of the thermal head 12.

When the photo printer 1 completes the printing of the images in cyan, the roll paper 11 is drawn out in step s21 based on the distal end detection timing obtained in step s11, until the rear end of the print region on which the images in cyan have been printed reaches the cutting position of a cutter (not shown). The print region on which the images of all three colors yellow, magenta, and cyan have been printed is cut off at its rear end with the cutter from the roll paper 11, and is ejected from the photo printer 1 (step s22). The roll paper 11 is subsequently rolled back in step s23, and the routine is completed.

In this manner, since the photo printer 1 of the present embodiment performs detection of both the distal edge and the side edges of the roll paper 11 with the line sensors 21*a* and 21*b*, it is unnecessary to install a separate distal edge sensor, which has been provided in conventional photo printers. Accordingly, it is possible to reduce the cost of manufacturing photo printers.

ALTERNATIVE EMBODIMENTS (a) Although two line sensors 21 are used in the photo printer 1 of the present embodiment to allow the two side edges of the roll paper 11 to be detected, a photo printer may be equipped with only one line sensor, in which case only one side edge of the roll paper is detected. In this case, the steps s35 and s36 of the threshold setting routine become unnecessary. In addition, the processing time required for the threshold setting routine can be reduced because only one line sensor is used for setting the threshold value.

(b) In the threshold setting routine, it is also possible to calculate only the external mean value of the line sensors 21*a* and 21*b* and set the threshold value as a value obtained by adding an adjustment value from the external mean value thus calculated. In this manner, the processing time required for the threshold setting routine can be further reduced.

Figure 8:
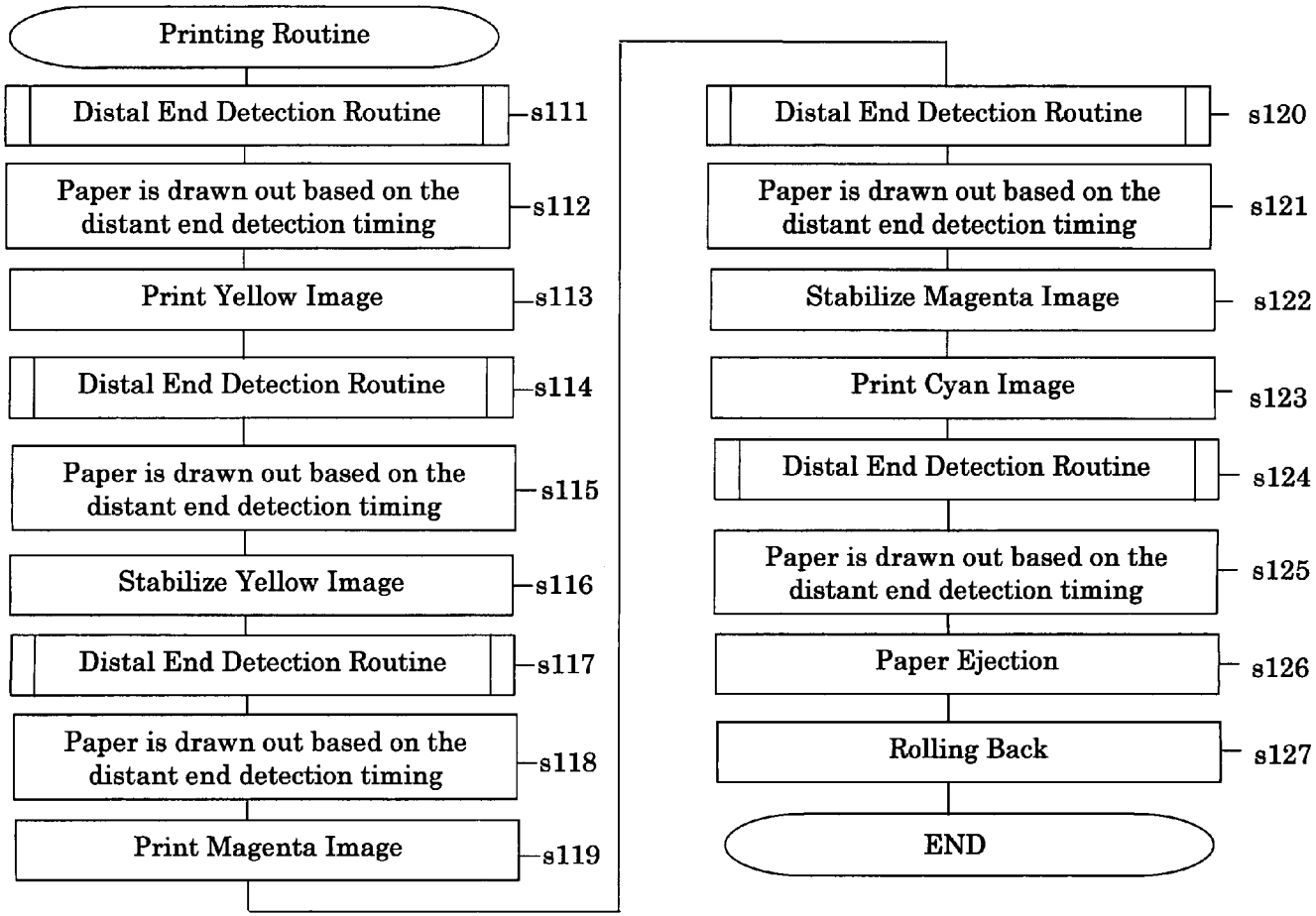
FIG. 8 is a flowchart showing the printing routine of the photo printer in accordance with an alternative embodiment of the present invention.

(c) Although the distal end detection routine is performed only once during the printing routine of the above described embodiment, the control unit could also be configured to perform the distal end detection routine every time the roll paper is to be rolled out in the ejection direction. More specifically, as seen in FIG. 8, the distal end detection routine is performed before the yellow images are printed (step s111), before the yellow images are stabilized (step s114), before the magenta images are printed (step s117), before the magenta images are stabilized (step s120), and before the print region of the roll paper is cut off (step s124). In this case, each rolling out of the roll paper following the distal end detection routine is controlled based on the distal end detection timing obtained during the immediately preceding distal end detection routine. For example, the roll paper is rolled out in step s114 based on the distal end detection timing obtained in step s113, while the roll paper is rolled out in step s125 based on the distal end detection timing obtained in step s124. In this case, it is determined whether the roll paper is in the conveyance path each time before an image is printed by the printing unit. Thus, it is possible to rapidly respond to any abnormalities that may occur while the roll paper is wound up by the paper feed unit or while other operations related to the printing of the preceding color images are performed.

According to this invention, the number of sensors to be installed on the photo printer can be reduced because one line sensor can be used to detect both the side edges and the distal end of roll paper conveyed along a conveyance path. Accordingly, the cost of manufacturing the photo printer can be reduced.

As used herein, the following directional terms "forward, rearward, above, downward, vertical, horizontal, below and transverse" as well as any other similar directional terms refer to those directions of a device equipped with the present invention. Accordingly, these terms, as utilized to describe the present invention should be interpreted relative to a device equipped with the present invention.

The term "configured" as used herein to describe a component, section or part of a device includes hardware and/or software that is constructed and/or programmed to carry out the desired function.

Moreover, terms that are expressed as "means-plus function" in the claims should include any structure that can be utilized to carry out the function of that part of the present invention.

The terms of degree such as "substantially", "about" and "approximately" as used herein mean a reasonable amount of deviation of the modified term such that the end result is not significantly changed. For example, these terms can be construed as including a deviation of at least ±5% of the modified term if this deviation would not negate the meaning of the word it modifies.

This application claims priority to Japanese Patent Application No. 2004-010557. The entire disclosure of Japanese Patent Application No. 2004-010557 is hereby incorporated herein by reference.

While only selected embodiments have been chosen to illustrate the present invention, it will be apparent to those skilled in the art from this disclosure that various changes and modifications can be made herein without departing from the scope of the invention as defined in the appended claims. Furthermore, the foregoing descriptions of the embodiments according to the present invention are provided for illustration only, and not for the purpose of limiting the invention as defined by the appended claims and their equivalents. Thus, the scope of the invention is not limited to the disclosed embodiments.

What is claimed is:

1. A photo printer adapted to print on a roll paper, comprising:

a conveyance unit that is adapted to convey the roll paper along a conveyance path;

a printing unit having a thermal head that is adapted to print in a main scanning direction on the roll paper, the main scanning direction being perpendicular to the conveyance direction of the roll paper;

a line sensor unit having a plurality of light emitting elements and a plurality of light receiving elements disposed so as to span a side edge of the conveyance path; and a control unit operatively coupled to the conveyance unit, the printing unit, and the line sensor unit, the line sensor unit being adapted to detect the roll paper on the conveyance path based on an amount of light received by the plurality of light receiving elements, the control unit being also adapted to detect a side edge of the roll paper based on the amount of light received by the plurality of light receiving elements, the control unit being further configured to determine that a distal end of the roll paper is detected based on the amount of light received by the plurality of light receiving elements.

2. The photo printer according to claim 1, wherein the line sensor unit has an external region and an internal region, the light-receiving elements that are disposed outside the conveyance path belonging to the external region, some of the light-receiving elements that are disposed inside the conveyance path belonging to the internal region, and the control unit is configured to determine that the roll paper is detected in setting the threshold value when a difference between the amounts of light received by the light-receiving elements in the external and internal regions exceeds a predetermined determination amount.

3. The photo printer according to claim 1, wherein the line sensor unit has two linen sensor components, each line sensor component being disposed so as to span either side edge of the conveyance path.

4. The photo printer according to claim 3, wherein the control unit is configured to store timing data indicating the time at which the control unit detects the distal edge of the roll paper based on the amount of light received by the light receiving elements from each line sensor component, and the control unit is further configured to calculate a corrected distal end detection timing, which is a mean value of the timing data of the line sensor components.

5. The photo printer according to claim 1, wherein the control unit and the line sensor unit are configured to detect the distal end of the roll paper before the printing unit prints the roll paper.

6. The photo printer according to claim 1, wherein the printing unit is adapted to print on the roll paper in a plurality of colors, and the control unit is configured to determine that the distal end of the roll paper is detected only before the printing unit prints on the roll paper in any of the plurality of colors.

7. A photo printer adapted to print on a roll paper, comprising:

a conveyance unit that is adapted to convey the roll paper along a conveyance path;

a printing unit having a thermal head that is adapted to print in a main scanning direction on the roll paper, the main scanning direction being perpendicular to the conveyance direction of the roll paper;

a line sensor unit having a plurality of light emitting elements and a plurality of light receiving elements disposed so as to span a side edge of the conveyance path; and a control unit operatively coupled to the conveyance unit, the printing unit, and the line sensor unit, the line sensor unit being adapted to detect the roll paper on the conveyance path based on an amount of light received by the tight receiving elements, the control unit being also adapted to detect a side edge of the roll paper based on the amount of light received by the light receiving elements, the control unit being further configured to determine that a distal end of the roll paper is detected based on the amount of light received by the light receiving elements, the line sensor unit having an external region and an internal region, the light-receiving elements tat are disposed outside the conveyance path belonging to the external region, some of the light-receiving elements that are disposed inside the conveyance path belonging to the internal region, and the control unit being configured to determine that the distal end of the roll paper is detected when a change in the amount of light received by the light receiving elements in the internal region exceeds a predetermined threshold value, the threshold value being a mean value of the amounts of light received by the light-receiving elements in the external and internal regions if the control unit detects the roll paper in the conveyance path, and a value obtained based on a predetermined adjustment value and the amount of light received by the light-receiving elements in the external or internal region if the control unit does not detect the roll paper in the conveyance path.

8. A photo printer for printing on a roll paper having heat-sensitive coloring layers of a plurality of colors, the photo printer comprising:

conveyance means for conveying the roll paper along a conveyance path;

printing means for printing on the heat-sensitive coloring layers of the roll paper in a main scanning direction, which is perpendicular to the conveyance direction of the roll paper;

edge detection means for detecting a side edge of the roll paper being conveyed by the conveyance means along the conveyance path; and control means for creating a distal end detection timing datum based on the detection of the roll paper by the edge detection means.

9. The photo printer according to claim 8, wherein the edge detection means has a plurality of light emitting elements and a plurality of light receiving elements disposed so as to span a side edge of the conveyance path, the edge detection means detecting the side edge of the roll paper based on an amount of light received by the light receiving elements, and the control means creates the distal end detecting timing datum when a change in the amount of light received by the light receiving elements exceeds a predetermined threshold value.

* * * * *